US010906310B2

(12) United States Patent
Kudo et al.

(10) Patent No.: US 10,906,310 B2
(45) Date of Patent: Feb. 2, 2021

(54) LIQUID EJECTION HEAD AND METHOD OF MANUFACTURING THE SAME

(71) Applicant: CANON KABUSHIKI KAISHA, Tokyo (JP)

(72) Inventors: Tomoko Kudo, Kawasaki (JP); Ryo Kasai, Tokyo (JP); Masafumi Morisue, Tokyo (JP); Yoshiyuki Nakagawa, Kawasaki (JP); Takuro Yamazaki, Inagi (JP); Takashi Sugawara, Yokohama (JP); Kazuhiro Yamada, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/136,550

(22) Filed: Sep. 20, 2018

(65) Prior Publication Data

US 2019/0092009 A1 Mar. 28, 2019

(30) Foreign Application Priority Data

Sep. 27, 2017 (JP) ..... 2017-186670

(51) Int. Cl.
*B41J 2/14* (2006.01)
*B41J 2/16* (2006.01)

(52) U.S. Cl.
CPC ..... *B41J 2/1433* (2013.01); *B41J 2/1404* (2013.01); *B41J 2/162* (2013.01); *B41J 2/164* (2013.01); *B41J 2002/14491* (2013.01); *B41J 2202/12* (2013.01)

(58) Field of Classification Search
CPC .... B41J 2/14129; B41J 2202/03; B41J 2/164; B41J 2/1433; B41J 2002/14491; B41J 2/162
See application file for complete search history.

(56) References Cited

U.S. PATENT DOCUMENTS

2006/0027529 A1* 2/2006 Tokunaga ..... B41J 2/161 216/27
2018/0154635 A1* 6/2018 Nakakubo ..... B41J 2/1623

FOREIGN PATENT DOCUMENTS

WO 2013/130039 A1 9/2013

OTHER PUBLICATIONS

Kasai et al., U.S. Appl. No. 16/136,563, filed Sep. 20, 2018.

* cited by examiner

*Primary Examiner* — Jannelle M Lebron
(74) *Attorney, Agent, or Firm* — Venable LLP

(57) ABSTRACT

A liquid ejection head including: a substrate; an energy generating element, which is provided on the substrate and is utilized to eject liquid; a first film provided on the energy generating element; a flow path forming member, which has an ejection orifice from which the liquid is ejected and forms a flow path of the liquid between the substrate and the flow path forming member; and an electrode, which generates a flow of the liquid, wherein the electrode includes the first film.

18 Claims, 7 Drawing Sheets

LIQUID EJECTION HEAD AND METHOD OF MANUFACTURING THE SAME

BACKGROUND OF THE INVENTION

Field of the Invention

The present invention relates to a liquid ejection head and a method of manufacturing the same.

Description of the Related Art

In a liquid ejection head for ejecting ink or other liquid, the liquid in an ejection orifice sometimes thickens since volatile components in the liquid evaporate from the ejection orifice from which the liquid is ejected. In this case, the ejection speed of the ejected droplets changes or the landing accuracy decreases in some cases. Particularly in the case of long suspension time after the ejection of the liquid, the increase in the viscosity of the liquid is remarkable. In such a case, solid components in the liquid adhere to the vicinity of the ejection orifice, which may increase the fluid resistance of the liquid due to the solid components, thereby causing an ejection failure in some cases. As one of measures against the thickening phenomenon of the liquid, there is a known method of drawing fresh liquid not thickening into the ejection orifice. As a method of drawing the liquid, there is a method using a μ pump such as with an alternating current electro-osmotic flow (ACEO) or the like (International Publication No. WO2013/130039), for example.

SUMMARY OF THE INVENTION

A liquid ejection head according to one aspect of the present invention includes: a substrate; an energy generating element, which is provided on the substrate and is used to eject liquid; a first film provided on the energy generating element; a flow path forming member, which has an ejection orifice from which the liquid is ejected and forms a flow path of the liquid between the substrate and the flow path forming member; and an electrode, which generates a flow of the liquid, wherein the electrode includes the first film.

A method of manufacturing a liquid ejection head according to another aspect of the present invention includes the steps of: forming a first film on an energy generating element, which is provided on the substrate and is used to eject liquid, and an electrode, which generates a flow of the liquid, collectively by using the same material; and forming a flow path forming member, which has an ejection orifice from which the liquid is ejected and forms a flow path of the liquid between the substrate and the flow path forming member, on the substrate.

Further features of the present invention will become apparent from the following description of exemplary embodiments with reference to the attached drawings.

DESCRIPTION OF THE EMBODIMENTS

Figure 1A:
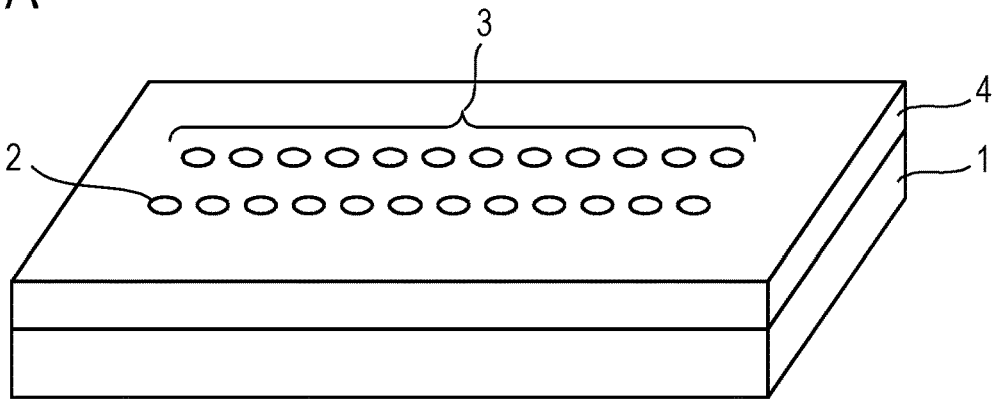
FIGS. 1A, 1B and 1C are diagrams including a perspective diagram, a schematic plan view, and a schematic cross-sectional view each illustrating an example of an embodiment of the present invention.

Preferred embodiments of the present invention will now be described in detail in accordance with the accompanying drawings.

In a method using a μ pump as described in International Publication No. WO2013/130039, an electrode for generating an alternating current electro-osmotic flow is arranged in a liquid ejection head. As for the material of the electrode, a material resistant to corrosion is generally used for a liquid such as ink containing Au, Pt, or the like as described in International Publication No. WO2013/130039. According to the studies of the present inventors, in the case of drawing fresh liquid not thickening into the ejection orifice by using the method using the μ pump, it is necessary to arrange the electrode in the liquid ejection head. Therefore, it is required to separately perform a step of forming the electrode in manufacturing the liquid ejection head, thereby increasing the manufacturing cost.

The present invention is directed to providing a low-cost liquid ejection head.

[Liquid Ejection Head]

A liquid ejection head according to the present invention includes a substrate, an energy generating element, a first film, a flow path forming member, and an electrode. The energy generating element is provided on the substrate and is used to eject liquid. The first film is provided on the energy generating element. The flow path forming member has an ejection orifice from which the liquid is ejected to form a flow path of the liquid between the substrate and the flow path forming member. The electrode generates a flow of the liquid. Incidentally, the electrode includes the first film.

Since the electrode includes the first film provided on the energy generating element in the liquid ejection head according to the present invention, the electrode is able to be formed together with the first film by using the same material as the first film when forming the first film. Therefore, the liquid ejection head is able to be manufactured without necessity for separately performing the step of forming the electrode in manufacturing the liquid ejection head, thereby reducing the manufacturing cost and providing a low-cost liquid ejection head.

Hereinafter, the liquid ejection head according to the present invention will be described with reference to the accompanying drawings. While the specific configuration of an ink jet recording head for ejecting ink as liquid, which is one embodiment of the present invention, is described in each embodiment described below, the present invention is not limited thereto. The liquid ejection head according to the present invention is applicable to a printer, a copying machine, a facsimile machine having a communication system, a word processor having a printer part, or other devices, and an industrial recording device combined with various processing devices in a complex manner. For example, the liquid ejection head according to the present invention is able to be used for biochip production, electronic circuit printing, or the like. In addition, the embodiments described below are appropriate specific examples of the present invention and therefore technically-preferable various limitations are given to the embodiments. It should be understood, however, that the embodiments are not limited to the embodiments of the present specifications or other specific methods without departing from the concept of the present invention.

First Embodiment

FIG. 1A is a perspective diagram illustrating an ink jet recording head according to this embodiment. A flow path forming member 4 is bonded onto a substrate 1 made of silicon or the like and a plurality of ejection orifices 2 is arranged in the flow path forming member 4. The plurality of ejection orifices 2 are arranged to form an ejection orifice array 3. From the viewpoint of increasing the degree of freedom in dimensions when forming the flow path forming member 4, the flow path forming member 4 may include an organic material such as epoxy resin.

Figure 1B:
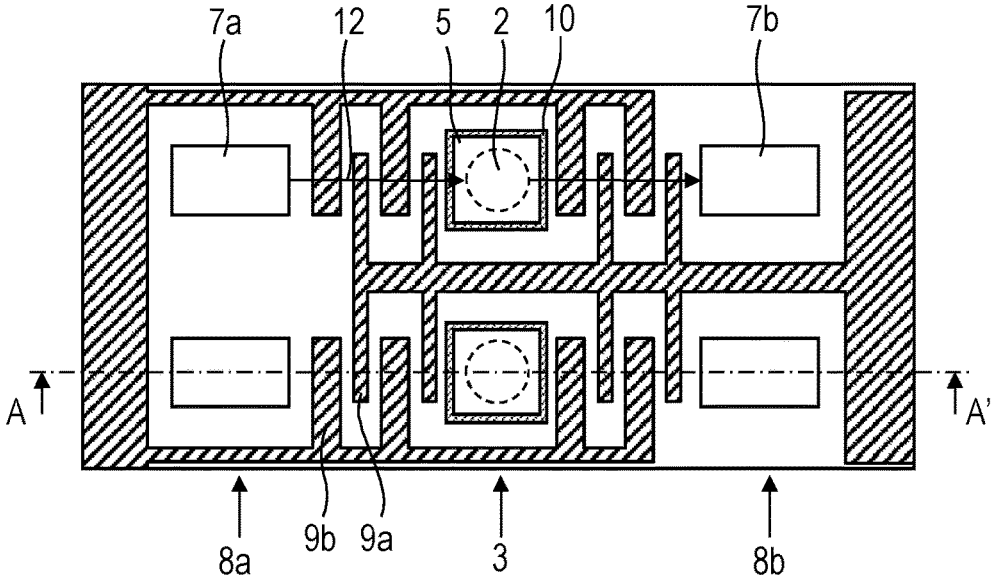
Figure 1C:
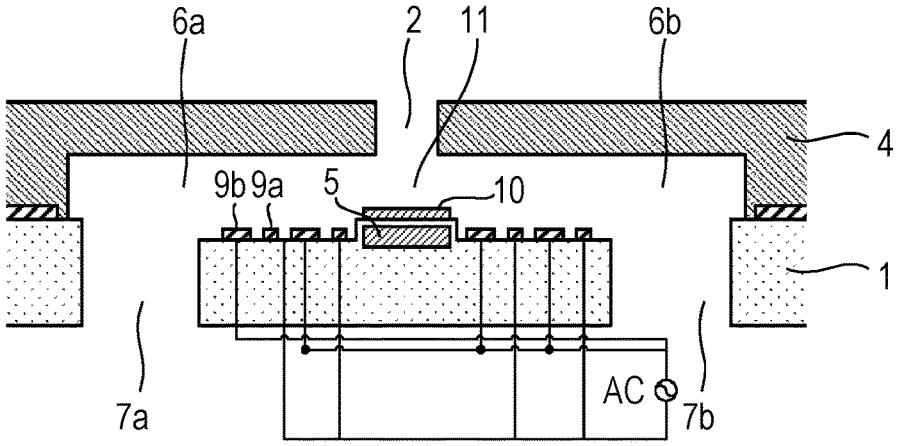

FIG. 1B is a schematic plan view illustrating an inside of an ink jet recording head according to this embodiment. FIG. 1C is a schematic cross-sectional view taken along line A-A' of FIG. 1B. The substrate 1 has an energy generation element 5 which generates energy for ejecting ink in a position opposite to each ejection orifice 2. The energy generation element 5 is provided thereon with an anti-cavitation film 10, which is formed of a first film to protect the energy generating element 5 from impact of cavitation. The substrate 1 has a first through hole 7*a* and a second through hole 7*b* passing through the substrate 1, which are formed for each ejection orifice 2. Between the flow path forming element 4 and the substrate 1, there are formed a first flow path 6*a* and a second flow path 6*b*, which are ink flow paths, in communication with the first through hole 7*a* and the second through hole 7*b*, respectively. Furthermore, a pressure chamber 11 is formed in a position between the flow path forming member 4 and the substrate 1 and where the energy generation element 5 and each ejection orifice 2 are arranged so as to be in communication with the first flow path 6*a* and the second flow path 6*b*. Therefore, the first through hole 7*a*, the first flow path 6*a*, the pressure chamber 11, the second flow path 6*b*, and the second through hole 7*b* have independent flow paths for each ejection orifice 2. The pressure chamber 11 has the energy generating element 5 inside. A plurality of first through holes 7*a* and a plurality of second through holes 7*b* form a first through hole array and a second through hole array 8*b*, respectively. The first through hole array 8*a* and the second through hole array 8*b* extend in parallel with the ejection orifice array 3 therebetween.

Ink is supplied from the first through hole 7*a* to the pressure chamber 11 passing through the first flow path 6*a*. The ink supplied to the pressure chamber 11 is heated by the energy generating element 5 and ejected from the ejection orifice 2 due to the power of generated bubbles. Ink not ejected from the ejection orifice 2 is guided from the pressure chamber 11 to the second through hole 7*b* passing through the second flow path 6*b*.

The substrate 1 in contact with the first flow path 6*a* and the second flow path 6*b* is provided on its surface with a first electrode 9*a* and a second electrode 9*b*. The first electrode 9*a* is connected to one end (positive terminal) of an alternating current power supply AC and the second electrode 9*b* is connected to the other end (negative terminal) of the alternating current power supply AC. Incidentally, the first electrode 9*a* may be connected to the minis terminal and the second electrode 9*b* may be connected to the positive terminal. In an ink flow direction 12, the width of the first electrode 9*a* is less than the width of the second electrode 9*b*. On the other hand, in a direction crossing perpendicularly to the ink flow direction 12, the first electrode 9*a* and the second electrode 9*b* are almost the same in length as each other. Therefore, the first electrode 9*a* is smaller in area in contact with ink than the second electrode 9*b*.

Figure 2A:
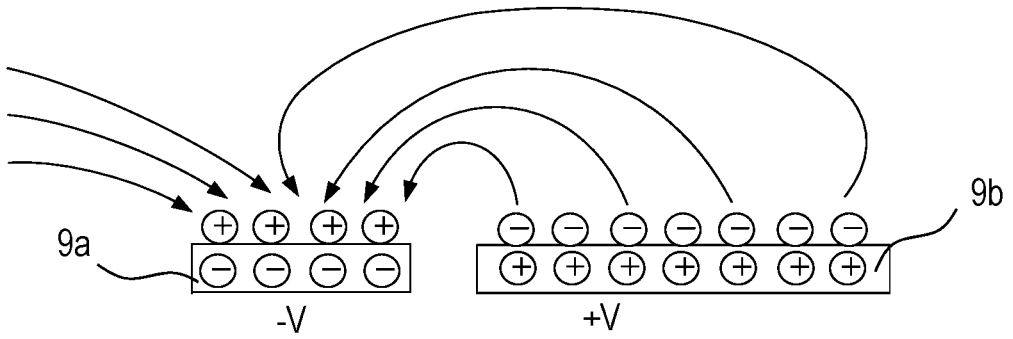
FIGS. 2A and 2B are schematic cross-sectional views illustrating a generation principle of an alternating current electro-osmotic flow.
Figure 2B:
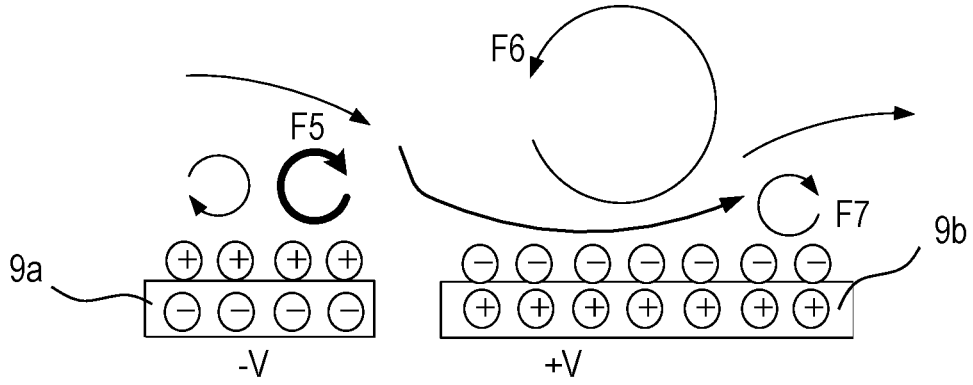

An alternating voltage is applied to the first electrode 9*a* and the second electrode 9*b*, thereby forming an electric double layer in a part where each electrode is in contact with ink. Since the first electrode 9*a* differs from the second electrode 9*b* in electrode area, the first electrode 9*a* differs from the second electrode 9*b* in electric field distribution as illustrated in FIG. 2A. Therefore, as illustrated in FIG. 2B, a small rotating eddy F5 having a high current speed is formed in the vicinity of the first electrode 9*a*. On the other hand, in the vicinity of the second electrode 9*b*, a small rotating eddy F7 having a low current speed is formed in a part low in potential and a large rotating eddy F6 having a high current speed is formed in a portion high in potential. As a result, ink is drawn into a gap between electrodes from the first electrode 9*a*, thereby generating an ink flow in which ink flows from the first electrode 9*a* to the second electrode 9*b*. Incidentally, this is the same as for a case where a positive voltage (+ voltage) is applied to the first electrode 9*a* and a negative voltage (– voltage) is applied to the second electrode 9*b*. Specifically, even if the polarity of the applied voltage is reversed, the sign of electric charges and the direction of the electric field are both reversed and therefore the direction of the generated ink flow does not change. Accordingly, there is generated a constant ink flow flowing from the first electrode 9*a* narrow in width in the ink flow direction 12 toward the second electrode 9*b* wide in width in the ink flow direction 12.

If the above electro-osmotic flow concentrated and thickened the ink inside the ejection orifices 2 and the pressure chamber 11, the concentrated ink can be prevented from staying in the ejection orifices 2 and in the pressure chamber 11. Therefore, fresh ink prevented from thickening is able to be ejected from the ejection orifices 2, thereby reducing color unevenness of an obtained image. Moreover, the electro-osmotic flow enables the ink in the pressure chamber 11 to circulate between the inside and the outside of the pressure chamber.

In this embodiment, the first electrode 9*a* and the second electrode 9*b* are formed of the first film which is the same as for the anti-cavitation film 10. As described above, the electrode that generates the electro-osmotic flow is in contact with ink directly and therefore is generally formed of Au or Pt that is resistant to corrosion by ink. In order to arrange the electrode inside the ink jet recording head, however, it is necessary to separately perform the step of forming the electrode in manufacturing the ink jet recording head, thereby increasing the manufacturing cost. Accordingly, in this embodiment, the first electrode 9*a* and the second electrode 9*b* are formed by using the anti-cavitation film 10 present inside the ink jet recording head. The anti-cavitation film 10 is directly in contact with ink inside the pressure chamber 11 and therefore Ta or Ir resistant to corrosion by ink is used as the material of the anti-cavitation film 10.

Therefore, the anti-cavitation film 10 is suitable also as a film for the electrode that generates the electro-osmotic flow. In other words, it is desirable that the first film includes at least one of Ta and Ir. If the anti-cavitation film 10 is used as the first electrode 9*a* and the second electrode 9*b*, the first electrode 9*a* and the second electrode 9*b* can be formed collectively in the step of forming the anti-cavitation film 10, thereby enabling the electrodes to be formed without separately adding the step of forming the electrodes.

The anti-cavitation film 10 may be a single layer including the first film made of, for example, Ta, Ir, or the like or may be a multi-layer including a plurality of first films made of Ta, Ir, and Ta or the like. If the anti-cavitation film 10 is a single layer, the first electrode 9*a* and the second electrode 9*b* are able to be single layers. If the anti-cavitation film 10 is a multi-layer, the first electrode 9*a* and the second electrode 9*b* are able to be multi-layers. Moreover, in the case where the anti-cavitation film 10 has a three-layer configuration including first films of three layers of Ta, Ir, and Ta, the three layers are collectively formed and thereafter only the Ta layer of the anti-cavitation film 10 may be removed in order to control the potential of the anti-cavitation film 10. In this case, the anti-cavitation film 10 has a two-layer configuration including the first films of two layers of Ir and Ta, and the first electrode 9*a* and the second electrode 9*b* each have a three-layer configuration including the first films of three layers of Ta, Ir, and Ta.

In this embodiment, there has been described an example that the first film provided on the energy generating element 5 is the anti-cavitation film 10. The first film provided on the energy generating element is not limited to the anti-cavitation film, but may be an insulating film, a wiring layer, a flow path forming member, or the like, for example.

Second Embodiment

Figure 3A:
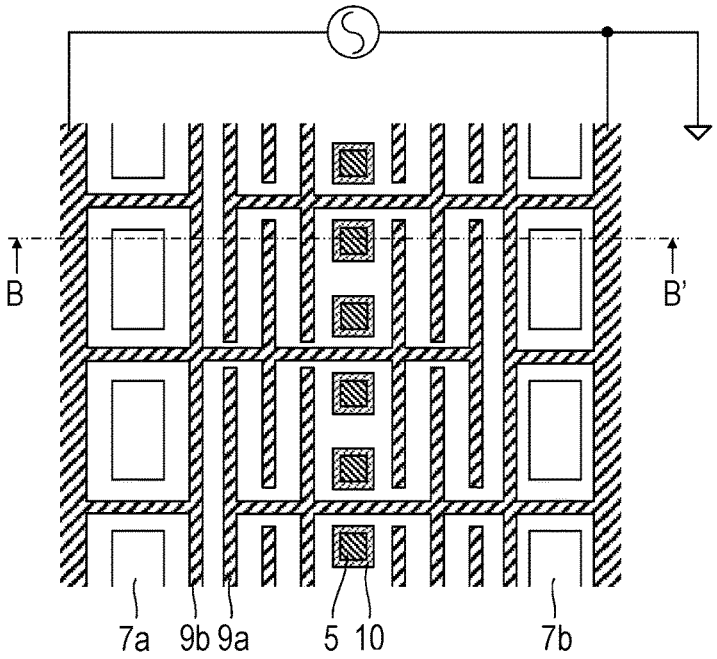
FIGS. 3A, 3B and 3C are diagrams including schematic plan views and a schematic cross-sectional view each illustrating an example of an embodiment of the present invention.
Figure 3B:
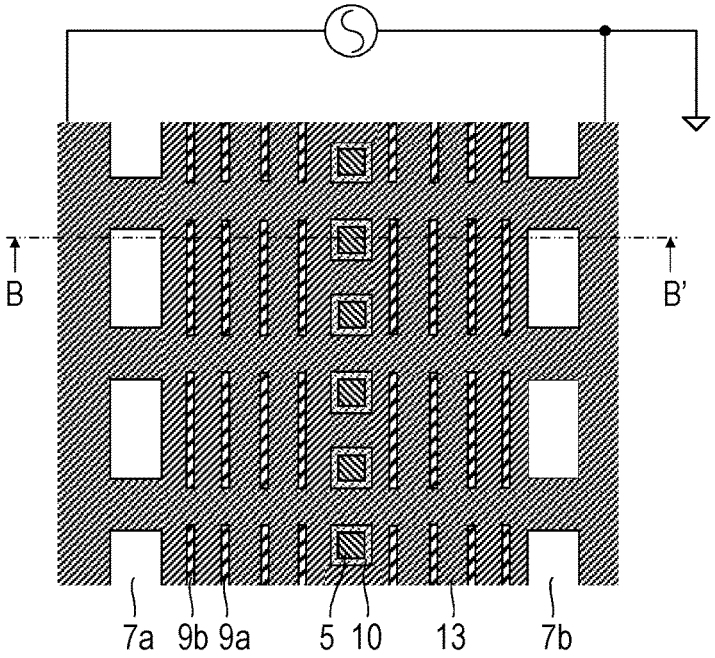
Figure 3C:
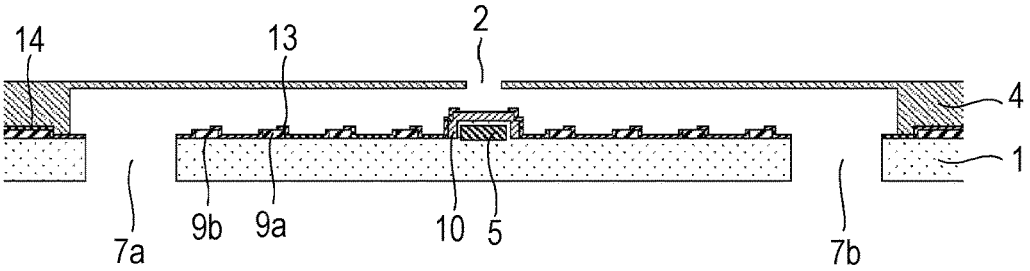

In the ink jet recording head according to this embodiment, at least one side of the end of the surface in contact with ink of the electrode is coated with an insulating film. FIGS. 3A to 3C illustrate an example of the ink jet recording head according to this embodiment. FIGS. 3A and 3B are schematic plan views each illustrating the ink jet recording head according to this embodiment. FIG. 3C is a schematic cross-sectional view taken along line B-B' of FIGS. 3A and 3B. Although an insulating film 13 is provided in this embodiment, formally the insulating film 13 is not illustrated in FIG. 3A and the insulating film 13 is illustrated in FIG. 3B for better understanding.

Figure 4:
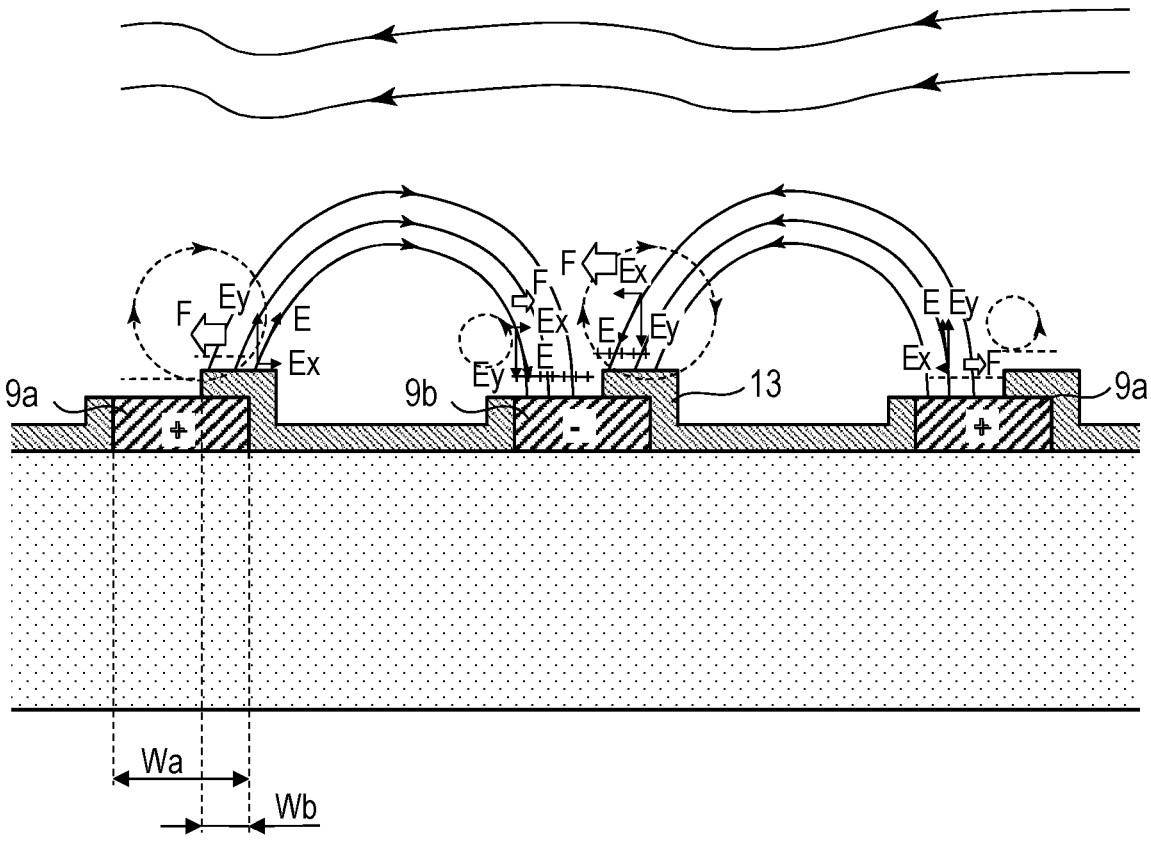
FIG. 4 is a schematic cross-sectional view illustrating an example of an embodiment of the present invention.

In this embodiment, as illustrated in FIGS. 3A to 3C, one side of the end of the surface in contact with ink of the first electrode 9*a* and that of the second electrode 9*b* are covered with the insulating film 13. At least one side of the end of the surface of the first electrode 9*a* and that of the second electrode 9*b* are coated with the insulating film 13 as described above, thereby enabling the generation of a one-way flow in the ink like an asymmetrical electrode with the electrodes different in area in the first embodiment described above. As illustrated in FIG. 4, an electric field is weakened in the portion coated with the insulating film 13 of the first electrode 9*a* and that of the second electrode 9*b* and therefore the inclination of lines of electric force decreases and the x component of the electric field (the component in the ink flow direction) increases. Since the magnitude of the Coulomb force is determined in proportion to the electric field, a relatively large eddy occurs on the portion coated with the insulating film 13 in comparison with a portion not coated with the insulating film 13 and the direction of the eddy determines the entire ink flow direction. In the case where at least one side of the end of the surface in contact with ink of the electrode is coated with the insulating film in this manner, it enables the current speed of the electro-osmotic flow to be increased and prevents bubbles from being generated by a chemical reaction of the electrode. The ratio of the coating width Wb with the insulating film 13 to the electrode width Wa in the ink flow direction (Wb/Wa) is desirably $0<Wb/Wa<0.5$.

Although FIGS. 3A to 3C and 4 illustrate an example that only one side of the end of the surface in contact with ink of each of the first electrode 9*a* and the second electrode 9*b* is coated with the insulating film 13, two sides opposing each other of the ends of the surface may be coated with the insulating film 13. In this case, the coating width with the insulating film 13 in one side is made wider than the coating width with the insulating film 13 in the other side, thereby causing an ink flow in the same manner as in the principle described above.

Although the insulating film 13 is not particularly limited as long as it is a film having insulation properties, the insulating film 13 is desirably an intermediate layer 14, which is provided between the substrate 1 and the flow path forming member 4 as illustrated in FIG. 3C and is an adhesion enhancing film that enhances the adhesion between the substrate 1 and the flow path forming member 4. In other words, the intermediate layer 14 is desirably made of the insulating film 13. In FIG. 3B, the insulating film 13 is formed on the entire substrate 1, with the exception of on the energy generating element 5 and some parts on the first electrode 9*a* and the second electrode 9*b*. Since a material having insulation properties is generally used for the intermediate layer 14, the application of the intermediate layer 14 to the insulating film 13 for coating the ends of the surface of the first electrode 9*a* and the second electrode 9*b* as described above enables the insulating film 13 to be formed together in the step of forming the intermediate layer 14. Therefore, the insulating film 13 is able to be formed without separately adding the step of forming the insulating film 13, thereby enabling a reduction in the manufacturing cost.

As for the material of the insulating film 13, it is desirable to use the material used for the intermediate layer 14 from a viewpoint that the insulating film 13 is also applicable to the intermediate layer 14. Specifically, the material may be a compound, a polyether amide, an epoxy resin, and the like each including at least one kind of elements selected from a group consisting of Si, C, and N. Either one kind of or two or more kinds of them may be used.

Third Embodiment

Figure 5A:
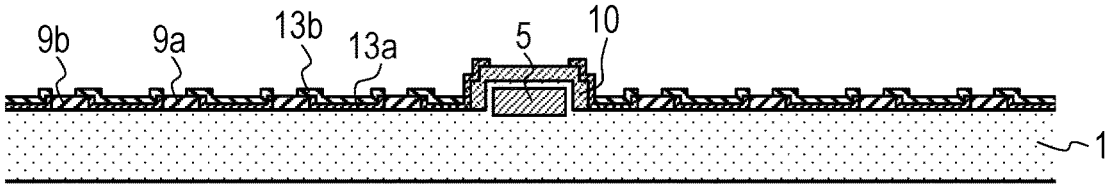
FIGS. 5A and 5B are schematic cross-sectional views illustrating an example of an embodiment of the present invention.
Figure 5B:
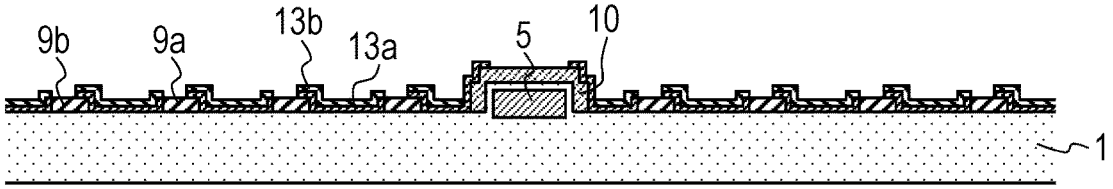

In an ink jet recording head according to this embodiment, the insulating film 13 in the second embodiment includes a plurality of films. In the case where the insulating film 13 is formed of a first insulating film 13*a* and a second insulating film 13*b*, at least one side of the end of the surface in contact with ink of the electrode may be coated with the second insulating film 13*b* and not be coated with the first insulating film 13*a*. Moreover, at least one side of the end of the surface in contact with ink of the electrode may be coated with the first insulating film 13*a* and with the second insulating film 13*b*. The intermediate layer 14 may include two or more layers including a layer more adhesive to the substrate 1 and a layer more adhesive to the flow path forming member 4. Therefore, also in the case where the insulating film 13 includes a plurality of films as described above, the insulating film 13 including the plurality of films is able to be collectively formed in the step of forming the intermediate layer 14. FIGS. 5A and 5B illustrate an example of the ink jet recording head according to this embodiment. FIGS. 5A and 5B are schematic cross-sectional views each illustrating the ink jet recording head according to this embodiment.

In the ink jet recording head illustrated in FIG. 5A, the insulating film includes the first insulating film 13*a* and the second insulating film 13*b*. Moreover, one side of the end of the surface in contact with ink of each of the first electrode 9*a* and the second electrode 9*b* is coated with the second insulating film 13*b* and not coated with the first insulating film 13*a*. Although the insulating film includes only one layer on the first electrode 9*a* and the second electrode 9*b* in the ink jet recording head illustrated in FIG. 5A, the film actually rises on the boundary of the first layer and the like and therefore the thickness of the film increases, by which it is assumed that the insulation effect increases.

In the ink jet recording head illustrated in FIG. 5B, the insulating film includes the first insulating film 13*a* and the second insulating film 13*b*. Moreover, one side of the end of the surface in contact with ink of each of the first electrode 9*a* and the second electrode 9*b* is coated with the first insulating film 13*a* and the second insulating film 13*b*. In the ink jet recording head illustrated in FIG. 5B, the insulating film includes two layers on the first electrode 9*a* and on the second electrode 9*b* and therefore the thickness of the insulating film increases, by which it is assumed that the insulation effect further increases.

[Method of Manufacturing Liquid Ejection Head]

A method of manufacturing a liquid ejection head according to the present invention includes the steps of: forming a first film on an energy generating element, which is provided on a substrate and is used to eject liquid, and an electrode, which generates a flow of the liquid, collectively by using the same material; and forming a flow path forming member, which has an ejection orifice from which the liquid is ejected and forms a flow path of the liquid between the substrate and the flow path forming member.

In the method of manufacturing the liquid ejection head according to the present invention, the first film on the energy generating element and the electrode are collectively formed by using the same material, and therefore it is unnecessary to separately perform the step of forming the electrode in manufacturing the liquid ejection head, thereby reducing the manufacturing cost. Hereinafter, description is made on the method of manufacturing an ink jet recording head, which is the liquid ejection head according to an embodiment of the present invention, with reference to the accompanying drawings.

Fourth Embodiment

Figure 6A:
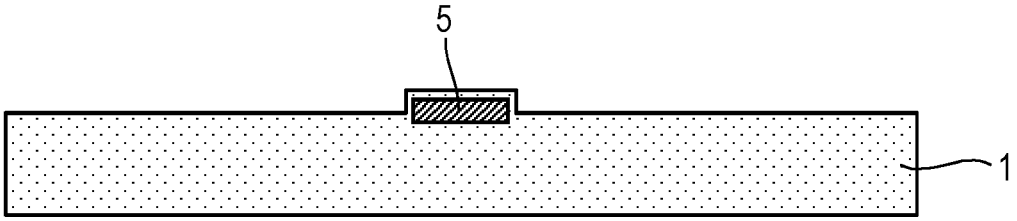
FIGS. 6A, 6B and 6C are schematic cross-sectional views illustrating an example of an embodiment of the present invention.
Figure 6B:
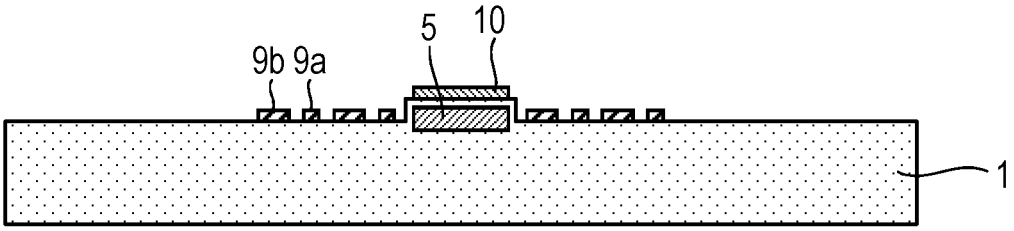
Figure 6C:
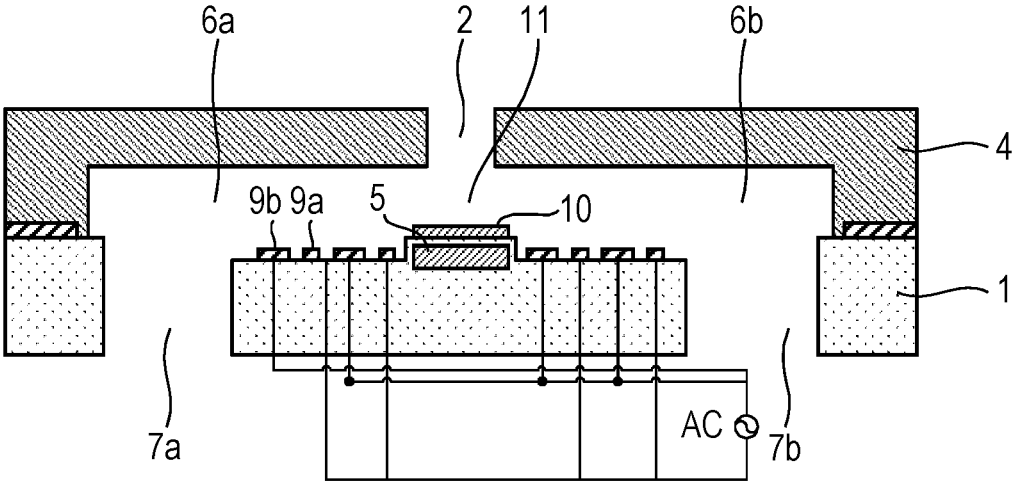

A method of manufacturing an ink jet recording head according to this embodiment is an example of a method of manufacturing the ink jet recording head according to the first embodiment. FIGS. 6A to 6C are schematic cross-sectional views illustrating each step of the method of manufacturing the ink jet recording head according to this embodiment. First, as illustrated in FIG. 6A, a substrate 1 provided with the energy generating element 5 is prepared. The substrate 1 of FIG. 6A is placed in a state where the formation of a transistor, wiring, the energy generating element 5, and the like is completed by the steps of forming an integrated circuit and forming the energy generating element 5.

Subsequently, as illustrated in FIG. 6B, the anti-cavitation film 10 on the energy generating element 5, the first electrode 9*a*, and the second electrode 9*b* are formed collectively by using the same material. In other words, the anti-cavitation film 10, the first electrode 9*a*, and the second electrode 9*b* are formed collectively by using a first film. For example, the first film may be formed on the entire substrate 1 and then a photolithographic technique may be used to form a pattern of the anti-cavitation film 10, the first electrode 9*a*, and the second electrode 9*b* with other portions removed.

Subsequently, as illustrated in FIG. 6C, there is formed a flow path forming member 4, which has an ejection orifice 2 and whish forms flow paths 6*a* and 6*b* between the substrate 1 and the flow path forming member 4, on the substrate 1, and there is formed a first through hole 7*a* and a second through hole 7*b* in the substrate 1. The formation of the flow path forming member 4 and the formation of the first through hole 7*a* and the second through hole 7*b* may be performed in a known method. Thereby, the ink jet recording head according to the first embodiment is acquired.

Fifth Embodiment

A method of manufacturing an ink jet recording head according to this embodiment is an example of a method of manufacturing the ink jet recording head according to the second embodiment. The method includes the step of forming an insulating film for coating at least one side of the end of the surface in contact with ink of the electrode, in addition to the steps of the fourth embodiment. Moreover, the insulating film is also provided as an intermediate layer between the substrate and the flow path forming member.

Figure 7A:
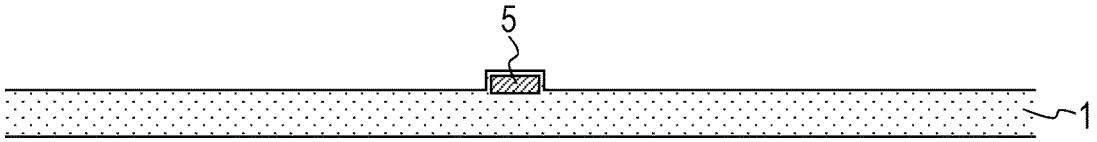
FIGS. 7A, 7B, 7C and 7D are schematic cross-sectional views illustrating an example of an embodiment of the present invention.
Figure 7B:
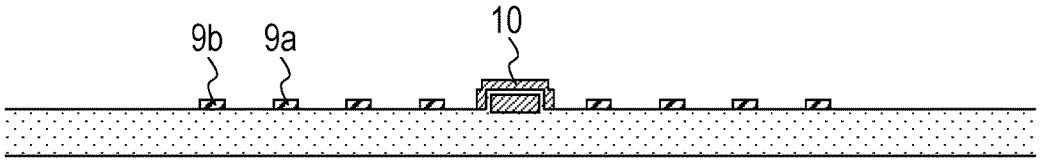

FIGS. 7A to 7D are schematic cross-sectional views illustrating the steps of the method of manufacturing the ink jet recording head according to this embodiment. First, as illustrated in FIG. 7A, the substrate 1 provided with the energy generating element 5 is prepared. Subsequently, as illustrated in FIG. 7B, the anti-cavitation film 10 on the energy generating element 5, the first electrode 9*a*, and the second electrode 9*b* are formed collectively by using the same material. The steps illustrated in FIGS. 7A and 7B are able to be performed in the same manner as in the fourth embodiment.

Figure 7C:
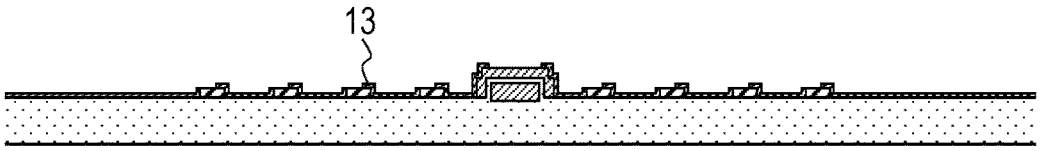
Figure 7D:
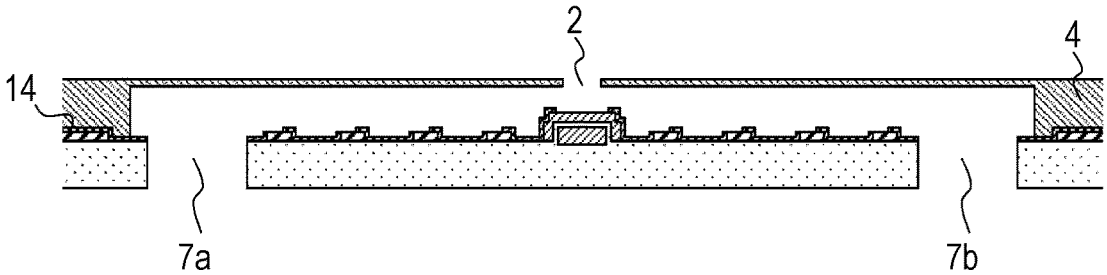

Subsequently, as illustrated in FIG. 7C, the insulating film 13 for coating one side of the end of the surface in contact with ink of each of the first electrode 9*a* and the second electrode 9*b* is formed. The insulating film 13 is not only used to coat one side of the end of the surface, but also serves as an intermediate layer 14 to enhance adhesion between the substrate 1 and the flow path forming member 4 as illustrated in FIG. 7D. For example, the intermediate layer 14 is able to be formed by forming the insulating film 13 on the entire substrate 1 and then removing the insulating film 13 on the energy generating element 5 and on some parts of the first electrode 9*a* and the second electrode 9*b* by etching or the like. Subsequently, as illustrated in FIG. 7D, the flow path forming member 4 is formed on the substrate 1 and then the first through hole 7*a* and the second through hole 7*b* are formed in the substrate 1. The step illustrated in FIG. 7D is able to be performed in the same manner as in the fourth embodiment. Thereby, the ink jet recording head according to the second embodiment is acquired. The ink jet recording head according to the third embodiment is able to be manufactured by using the same method as this embodiment with the exception that the insulating film 13 includes the plurality of films.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-186670, filed Sep. 27, 2017, which is hereby incorporated by reference herein in its entirety.

What is claimed is:

1. A liquid ejection head comprising:

a substrate;

an energy generating element, which is provided on the substrate and is used to eject liquid;

a first film provided on the energy generating element;

a flow path forming member, which has an ejection orifice from which the liquid is ejected and forms a flow path of the liquid between the substrate and the flow path forming member; and an electrode which generates a flow of the liquid, wherein the electrode includes the first film, and wherein at least one side of an end of a surface of the electrode, which is in contact with the liquid, is coated with an insulating film.

2. The liquid ejection head according to claim 1, wherein the energy generating element is provided thereon with an anti-cavitation film including the first film.

3. The liquid ejection head according to claim 1, wherein the first film includes at least one of Ta and Ir.

4. The liquid ejection head according to claim 1, wherein:

two sides opposing each other of ends of the surface of the electrode, which is in contact with the liquid, are coated with the insulating film; and a coating width with the insulating film of one side of the two sides is wider than a coating width with the insulating film of another side of the two sides.

5. The liquid ejection head according to claim 1, wherein:

an intermediate layer is provided between the substrate and the flow path forming member; and the intermediate layer is formed of the insulating film.

6. The liquid ejection head according to claim 1, wherein the insulating film includes at least one selected from a group consisting of a compound, a polyether amide, and an epoxy resin each including at least one element selected from a group consisting of Si, C, and N.

7. The liquid ejection head according to claim 1, wherein the insulating film includes a plurality of films.

8. The liquid ejection head according to claim 7, wherein:

the insulating film includes a first insulating film and a second insulating film; and at least one side of the end of the surface of the electrode, which is in contact with the liquid, is coated with the second insulating film and is not coated with the first insulating film.

9. The liquid ejection head according to claim 7, wherein:

the insulating film includes a first insulating film and a second insulating film; and at least one side of the end of the surface of the electrode, which is in contact with the liquid, is coated with the first insulating film and the second insulating film.

10. The liquid ejection head according to claim 1, wherein the energy generating element is provided inside a pressure chamber and the liquid in the pressure chamber is circulated between the inside and the outside of the pressure chamber.

11. A method of manufacturing a liquid ejection head comprising steps of:

forming a first film on an energy generating element, which is provided on a substrate and is utilized to eject liquid, and an electrode, which generates a flow of the liquid, collectively by using the same material;

forming a flow path forming member, which has an ejection orifice from which the liquid is ejected and forms a flow path of the liquid between the substrate and the flow path forming member, on the substrate; and forming an insulating film for coating at least one side of an end of a surface of the electrode, which is in contact with the liquid.

12. The method of manufacturing the liquid ejection head according to claim 11, wherein the liquid ejection head includes an anti-cavitation film including the first film on the energy generating element.

13. The method of manufacturing the liquid ejection head according to claim 11, wherein the material includes at least one of Ta and Ir.

14. The method of manufacturing the liquid ejection head according to claim 11, wherein:

the step of forming the insulating film is a step of coating two sides opposing each other of ends of the surface of the electrode, which is in contact with the liquid, with the insulating film; and a coating width with the insulating film of one side of the two sides is wider than a coating width with the insulating film of another side of the two sides.

15. The method of manufacturing the liquid ejection head according to claim 11, wherein the insulating film is provided as an intermediate layer between the substrate and the flow path forming member.

16. The method of manufacturing the liquid ejection head according to claim 11, wherein the insulating film includes at least one selected from a group consisting of a compound, a polyether amide, and an epoxy resin each including at least one element selected from a group consisting of Si, C, and N.

17. The method of manufacturing the liquid ejection head according to claim 11, wherein the insulating film includes a plurality of films.

18. The method of manufacturing the liquid ejection head according to claim 17, wherein:

the insulating film includes a first insulating film and a second insulating film; and at least one side of the end of the surface of the electrode, which is in contact with the liquid, is coated with the second insulating film and is not coated with the first insulating film in the step of forming the insulating film.

* * * * *